US005558416A

United States Patent [19]

Dumitru

[11] Patent Number: 5,558,416

[45] Date of Patent: Sep. 24, 1996

[54] CABINET FOR DISPLAYING OBJECTS

[75] Inventor: Florea Dumitru, Nidderau, Germany

[73] Assignee: Glasbau Hahn GmbH & Co. KG, Germany

[21] Appl. No.: 389,901

[22] Filed: Feb. 16, 1995

[30] Foreign Application Priority Data

Feb. 18, 1994 [EP] European Pat. Off. ..... 94102459

[51] Int. Cl.[6] ..... A47F 3/00; E06B 3/00

[52] U.S. Cl. ..... 312/139; 312/114; 312/322; 312/138.1; 312/139.1; 49/386; 16/82; 16/84

[58] Field of Search ..... 312/139, 114, 312/138.1, 139.1, 322; 49/386; 16/82, 84

[56] References Cited

U.S. PATENT DOCUMENTS

| | | | |
|---|---|---|---|
| 1,953,357 | 4/1934 | Leya | 312/114 X |
| 2,211,581 | 8/1940 | Ross | 16/179 |
| 2,975,013 | 3/1961 | Wallace et al. | 312/296 |
| 3,353,888 | 11/1967 | Pritelli, Jr. | 312/114 X |
| 3,624,864 | 12/1971 | Marr | 49/386 X |
| 3,818,637 | 6/1974 | Vivier | 49/386 X |
| 4,208,840 | 6/1980 | Jentoft et al. | 49/386 X |
| 4,265,051 | 5/1981 | Williams | 49/386 X |
| 4,338,990 | 7/1982 | Blodee et al. | 312/265.5 X |
| 4,899,420 | 2/1990 | Bye et al. | 49/386 X |
| 5,040,857 | 8/1991 | Mandel et al. | 312/214 |
| 5,048,150 | 9/1991 | Guerin | 16/82 X |
| 5,274,954 | 1/1994 | Quarfordt et al. | 49/386 |

FOREIGN PATENT DOCUMENTS

| | | | |
|---|---|---|---|
| 577279 | 5/1933 | Germany | 312/114 |
| 3533988 | 9/1985 | Germany . | |
| 3602539 | 1/1986 | Germany . | |

*Primary Examiner*—Peter M. Cuomo
*Assistant Examiner*—Rodney B. White
*Attorney, Agent, or Firm*—Haynes and Boone, L.L.P.

[57] ABSTRACT

A cabinet for displaying objects, consists of a plurality of sides, of which one side is in the form of a door and bears in the closed state on the end surfaces of the two adjoining sides, wherein its outer edges are aligned with the outsides of these sides. The cabinet comprises two hinges arranged one above the other, each consisting of a door hinge part fixed to the door and a housing hinge part, which are rotatably connected together by a pin. Each housing hinge part is fitted on the end of a rod which is movable axially and perpendicular to the closing plane of the door in a bearing body fixed on a lower sheet metal frame located in the lower part of the cabinet or a bearing body fixed on an upper sheet metal frame located in the upper part. In the region of the lower part of the cabinet a gas pressure spring is fitted horizontally in the region of the lower part of the cabinet between the lower sheet metal frame and the door. On opening the door the two rods are firstly pulled out of the bearing bodies by means of a link, so that the outer edge of the door comes free for the following pivotal movement. The gas pressure spring prevents the rod from being pushed back into bearing body on account of the weight of the door when the door is opened.

20 Claims, 4 Drawing Sheets

CABINET FOR DISPLAYING OBJECTS

This invention relates to a cabinet for displaying objects, with a plurality of sides consisting of transparent material, an underpart in the form of a pedestal and an upper part closing the top side, wherein at least one side part is in the form of a hinged door, which is attached to the cabinet by corresponding hinges, and wherein the end surfaces of two opposed sides abut the inside of the door at the marginal region thereof in the closed state of the door, wherein the opposite outer edges of the door terminate flush with the outside of the two sides respectively.

Such a cabinet is already known. Thus a cabinet is described in DE-PS 3 602 539, wherein the rectangular cabinet housing formed from panels comprises a rear wall, two sides and a hinged double door, wherein the double door is pivotally mounted by hinges fitted in suitably provided invisible regions of the panels.

If now it is required that the door shall close on to the corresponding end edges of the two sides in the closed state, while the outer edges of the door are flush with the outsides of the sides, the hinges have to be specially formed, so that the door can open and not press against the end edge on the hinge side.

The object of the invention therefore consists in providing a suitable fixing for the door of such a cabinet.

This object is met in that a hinge is fitted on the inner side of the door in the region of each of the upper part and the underpart, the hinge consisting of a door hinge part rotatably attached to a corresponding housing hinge part by means of a pin, in that the housing hinge part forms one end of a rod which is mounted to move axially perpendicular to the closing plane of the door in a lower bearing body fixed to an upper sheet metal frame fitted in the upper part, and in that a horizontal spring-like means is so fixed rotatably at one end to the lower sheet metal frame in the region of the lower hinge and at the other end to the door that a predetermined pressure is exerted from the inside of the cabinet against the lower part of the door even in the closed state of the door.

Because of the two housing hinge parts connected to the rods which are movable axially in the bearing bodies, the door can firstly be pulled forwards and as soon as the necessary spacing from the end edge of the side in question has been attained it can also be swung forward. However, because of the high weight of the door, a greater pressure is exerted on the lower hinge in the open state of the door, so that the rod of the lower hinge would be pushed back again into the bearing body. This pressure is counteracted by the spring-like means adjusted in accordance with the weight of the door, for example a gas pressure spring.

From DE-PS 3 533 988 a housing is already known with a housing cover, in which a pull-out part is located between a housing hinge part and hinge middle part, wherein the pull-out part is connected to move linearly relative to the housing hinge part at an angle to the closing plane. The hinge middle part is pivotally linked to both the cover hinge part and the pull-out part. A housing of this form facilitates complete closure of the housing space by a cover, in which the outer sides of the housing cover close flush on to the outer side of the housing sides and housing cover bears in the closed state on the end sides of the housing sides.

A door hinge for a refrigerator is described in U.S. Pat. No. 5,040,857, in which the door is guided parallel on to the door frame in the last phase of the closing. The upper end lower hinges are each fixed on to a rack which can move perpendicular to the door. The two racks are mechanically connected together by a common vertical shaft, on which a gearwheel is fixed in the region of each of the upper and the lower racks, in engagement with the corresponding rack. Parallel guiding of the door is achieved in this way.

Advantageous developments of the invention appear from the dependent claims.

The invention will be explained in more detail with reference to an embodiment which is shown in the drawings, wherein.

Figure 1:
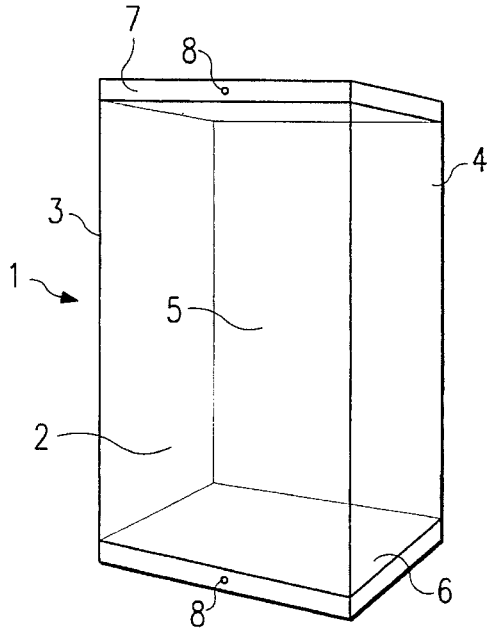
FIG. 1 is a perspective view of a cabinet.

The cabinet according to FIG. 1 comprises a left side 3 and a right side 4 which are opposite and parallel to one another. In between them there are a rear side 5 on the side away from the viewer and, parallel thereto, a hinged door 2 on the side facing the viewer. In the embodiment the assumption is that the cabinet is a glass housing with a rectangular plan. The invention can however, be used with a housing of another transparent material and with a five or more sided plan. The cabinet 1 has an underpart 6 as a pedestal and an upper part 7 as the upper closure. The door is provided with a centrally arranged lock 8 in the region of each of the underpart 6 and the upper part 7.

A sheet metal plate 41 is fixed, for example by an adhesive, on the inside of the door in the region of each of the underpart 6 and the upper part 7 (see FIGS. 2 to 5). This carries all of the devices which are attached to the hinge mechanism and the lock 8 and which pertain to the door 2 itself. These can be attached to the sheet metal plate 41 by screws, welding, etc. for example.

A lower sheet metal frame 12 is fitted inside the underpart 6 and an upper sheet metal frame 36 is fitted inside the upper part 7. Each frame extends for example from the left side 3 to the right side 4 and possibly also up to the rear side 5, where the two sides 3 and 4 and the rear side 5 also can be attached to the two sheet metal frames 12 and 36 by an adhesive for example. In between each of the lower sheet metal frame 12 and the upper sheet metal frame 36 and the door 2 there is a space 40, in which all of the devices which are fitted to the two sheet metal plates 41 and to the two sheet metal frames are accommodated.

In the closed state the marginal regions of the door 2 bear on the front ends of the two sides 3 and 4, so that the corresponding outer edges 43 and 44 of the door 2 are in alignment with the outsides of the respective sides 3 and 4. The door 2 and the sides 3, 4 and 5 can each extend from the under edge of the underpart 6 up to the top edge of the upper part 7. In this case a foil 13 can be applied to the inside of the sides 3, 4 and 5 and the door 2 in the region of the underpart 6 and the upper part 7, by means of which the two sheet metal frames 12 and 36 and also the space 40 are covered.

The construction of the two hinges will be dealt with in the following, a hinge being located in each of the underpart 6 and the upper part 7. It will be assumed that both hinges are located on the door 2 on the side facing the left side 3. It is equally conceivable that they are fitted on the side of the door 2 facing the right side 4. The cabinet 1 can also have more than one door 2. Since both hinges have the same construction, only one hinge will be described. The door hinge part 10, which is rigidly fixed on the sheet metal plate 41, is connected rotatably to the housing hinge part 9 by the pin 11, whose axis extends vertically. The housing hinge part 9 is fitted on the end of a rod 15 movably horizontally in the direction out of the closing plane of the door 2, the rod being guided in a bearing body 14 fixed to the lower 12 or upper sheet metal frame 36. The bearing body 14 is open at its end facing away from the door 2, so that the rod 15 projects out thereof. The rod 15 has a stop 16 at this end, which restricts the stroke of the rod 15 in the bearing body 14 to a certain length.

Figure 5:
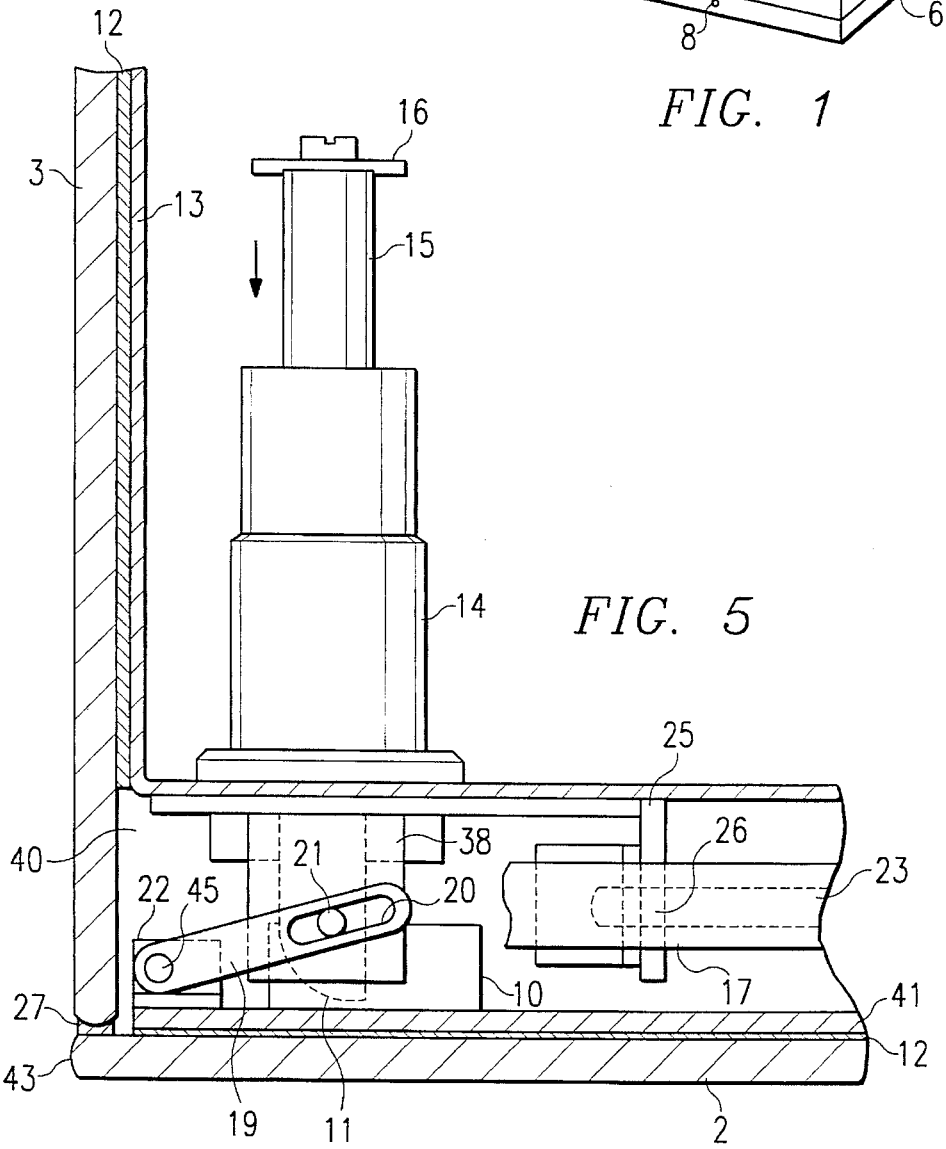
FIG. 5 is an enlarged showing of a further portion of FIG. 2.
Figure 2:
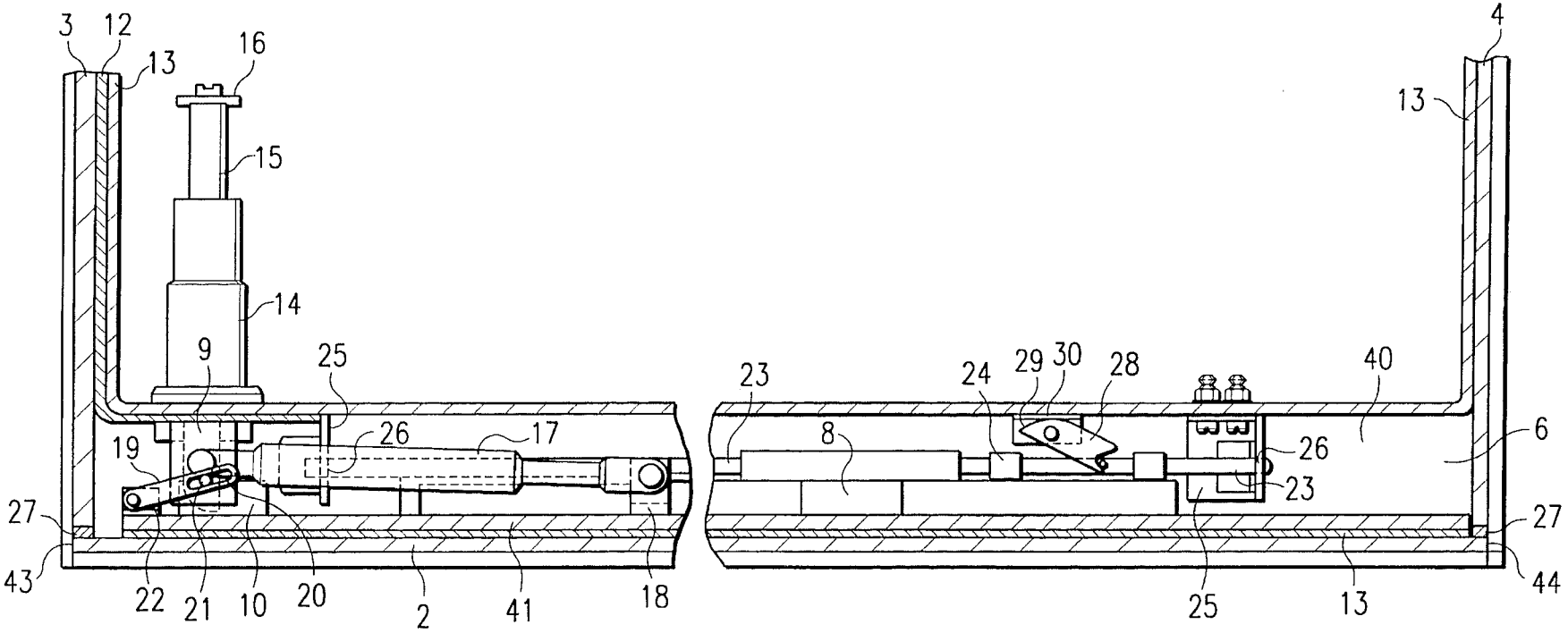
FIG. 2 is a horizontal section through the cabinet at the level of the upper edge of the underpart.
Figure 3:
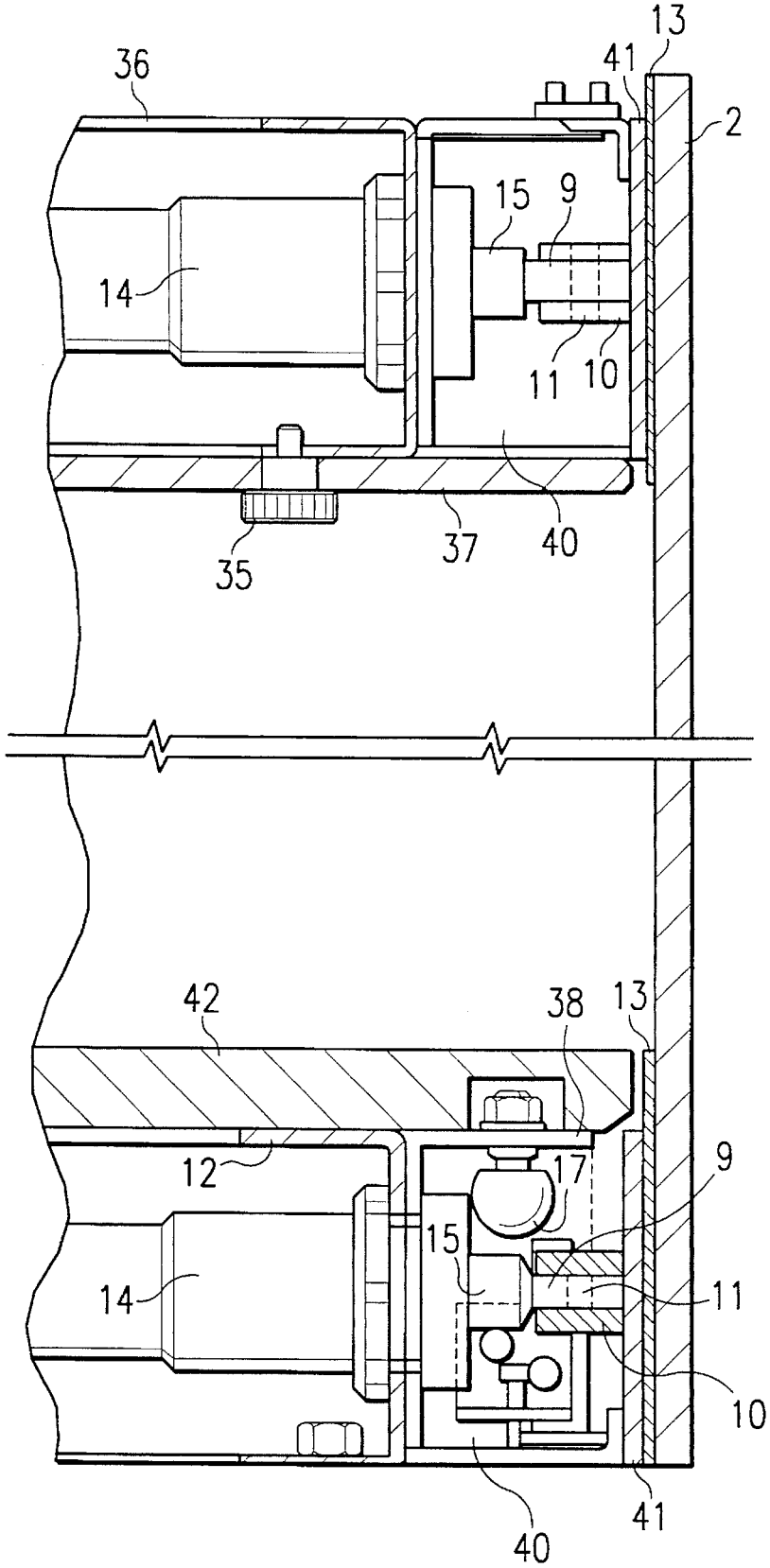
FIG. 3 is a vertical section through the cabinet parallel to one side.
Figure 4:
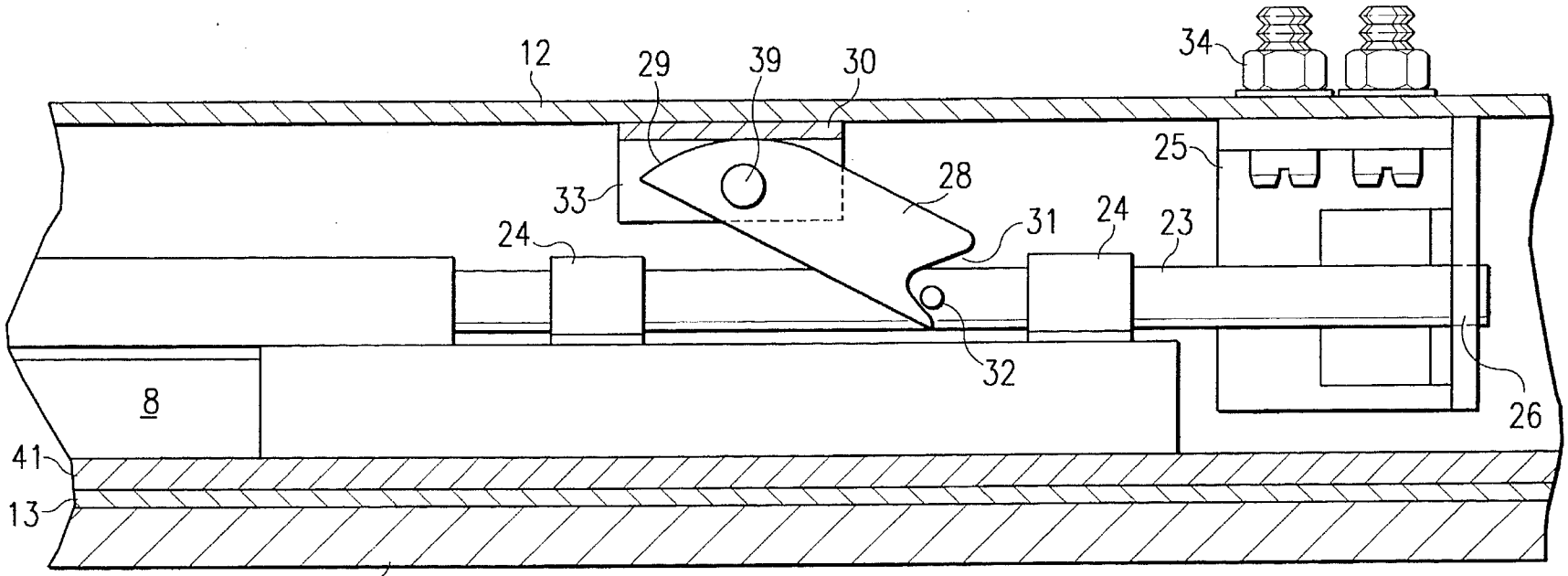
FIG. 4 is an enlarged showing of a portion of FIG. 2

A support bracket 22 is also fixed on the sheet metal frame 41 of the door, namely between the door hinge part 10 and the left side 3 adjacent the hinge. A horizontal link 19 is fitted rotatably on the support bracket 22 by means of a bore 45 and has a slot 20 at its other end. A vertical stud 21 which is fixed to a connecting bracket 38 attached to the lower 12 or upper sheet metal frame 36 projects into this slot 20. The link 19 can be made from a piece of flat steel. The distance between the end of the slot 20 remote from the bore 45 and the bore 45 of the link 19 is so selected that, on opening the door 2, this firstly moves parallel away from the end edges of the sides 3 and 4, in that the rod 15 is pulled out of the bearing body 14 up to the stop 16 and the stud 21 moves in the slot 20 up to the end remote from the bore 45, so that the door 2 can then be swung out, since there is now enough space for the door to swing out, in respect of the part thereof which is located between the hinge and the outer edge 43. This part turns in towards the interior of the cabinet 1 as the door 2 swings out. During the pivotal movement of the door, the stud 21 stays at the end of the slot 20 in the link 19 remote from the bore 45, so that the bore 45 executes a circular movement. In the state of widest opening of the door 2, this is parallel to the side 3 while the link 19 assumes approximately the same position. The pivotal movement of the door 2 in the closing operation is also guided by the link 19. The length of the slot 20 of the link 19 is such that the door 2 can bear against the end edges of the two sides 3 and 4, i.e., so that the stud 21 and the link 19 do not interfere with the parallel movement in the last phase of closing the door 2. The stud 21 moves in the slot 20 to the end thereof adjacent to the bore 45. In the closed state of the door 2, the link 19 is approximately parallel to the door 2, as shown in FIG. 5. A support bracket 22, a stud 21 and a link 19 are provided for each hinge both in the underpart 6 and in the upper part 7 of the cabinet 1, while the stud 21 can also be fitted on a separate bracket fixed to the lower 12 or upper sheet metal frame 36.

A gas pressure spring 17 is fixed rotatably on the attachment bracket 38 fitted on the lower sheet metal frame 12, namely on the lower side of the attachment bracket 38, the pivot point being in alignment with the axis of the rod 15 sidably guided in the bearing body 14. The pivot point further lies between the pin 11 of the hinge 9, 10 and the lower sheet metal frame 12. The attachment bracket 38 is fitted above the hinge 9, 10 but it could be fitted underneath the same. It is also conceivable to fit the gas pressure spring 17 on a separate attachment bracket. The horizontally disposed gas pressure spring 17 is rotatably connected at its other end to a bearing 18, which is fitted on the door, namely on the sheet metal plate 41 between the hinge 9, 10 and the lock 8. The distance between the pivot point of the gas compression spring 17 in the bearing 18 and the inside of the door is so chosen that the gas compression spring 17 already exerts pressure against the inside of the door 2 in the closed state of the same. The gas compression spring 17, whose force can be adjusted, is matched to the weight of the door 2, to the end that no pressure directed to the interior of the cabinet 1, which would result in the rod 15 being pressed back into the bearing body 14 fitted on the lower sheet metal frame 12, can result on account of the weight of the door 2 in the lower region of the door 2 when the door is pulled out parallel through the axial movement of the rods 15 of the two housing hinge parts 9.

Continuous strips 27 are fitted at least on the points of contact with the front ends of the sides 2 and 4 and the inside marginal region of the door 2 and on the end sides of the sides 3 and 4 themselves, so that these register with one another in the closed state of the door 2. Likewise the strips 27 can be fitted on all of the four marginal regions of the door 2, so that the door 2 can be kept closed dust-fight. The counterparts for the strips 27 are then applied to suitable strips, not shown, which are to be fixed to the lower 12 and upper sheet metal frame 36. The width of the strips is so selected that they are not larger than the thickness of the sides 3 and 4, if the optical impression is not to be affected and the holding force of the strips 27 is sufficient. Otherwise the front ends of the sides 3 and 4 should be suitably widened to receive a wider strip 27. Because of the special formation of the strips 27 a releasable connection results therebetween when they are pressed together.

The strip 27 consists of two parts, namely one part of a filamentary plastics fleece, into which the innumerable small hooks of the other part dig through the pressing together. The firm connection between the two strips 27 or between the two cabinet parts to which they are fixed can be released again by tearing the two strips or parts apart. This operation can be repeated as often as liked subject to the appearance of certain wear effects. Such strips are also known by the name of "burr fasteners".

The lock 8 fitted on the door 2 or on the sheet metal plate 41 centrally in each of the regions of the underpart 6 and the upper part 7 operates two horizontal push rods 23 in such a way that these are driven apart in the locking operation and are moved together in the opening operation. The push rods 23 are guided through supports 24 which are fitted to the sheet metal plate 41. In the closed state of the door 2 and the locked state of the lock 8, the ends of the two push rods 23 project into bores 26 in brackets 25 fixed to the lower 12 or upper sheet metal frame 36 in the region of the two sides 3 and 4.

The push rod 23 is provided with a stud 32 at the end remote from the hinge 9, 10 and in the vicinity of the bracket 25, the stud being directed up or down and being fixed and engaging in a receiving opening 31 of a lever 28 in the locked state of the door 2. The lever 28 is mounted rotatably on a bearing block 33 fixed to the lower 12 or upper sheet metal frame 36 by means of a pin 39. On the side of the lever 28 remote from the receiving opening 31 it is provided with a curve 29, which bears on a rubber plate 30 fitted on the lower 12 or upper sheet metal frame 36. The bore for the pin 39 is located between the receiving opening 31 and the curve 29. The receiving opening 31 is of such form that, in the closed state of the door 2, on shifting the push rod 23 in the direction of the lock, i.e., in unlocking this, the lever 28 is pressed against the rubber plate 30 by the engagement of the stud 32 in the receiving opening 31 and in this way pressure is exerted against the door 2 from the inner space of the cabinet 1, through which the holding action of the strips 27 is counteracted by tearing them apart. The door 2 thus only has to be moved by the lever 28 until at least the strips 27 have come free from the front end of the right side 4 and the door 2 in the region of the outer edge 44.

If the push rod 23 is moved in the direction of the bracket 25 in the action of locking the lock 8, the stud 32 firstly slides along the outside of the lever 28, so that its curve 29 is pressed against the rubber plate 30 and pressure is exerted against the stud 32, and arrives then in the end position of the push rod 23 in the receiving opening 31 again, whereby the lever 28 again assumes the rest position determined by the curve 29 bearing against the rubber plate 30. The pivot point of the lever 28, which can be made out of a piece of flat steel, lies between the receiving opening 31 and the curve 29.

The upper sheet metal frame 36, which adjoins the cabinet 1 at the top can for example receive a lighting fitting, not shown, while a glass plate 37 which can be fixed from below by knurled screws 36 can close the interior space of the cabinet at the top. The interior space of the cabinet can be bounded at the bottom by a floor 42, for example a wooden board, resting on the lower sheet metal frame 12 and fixed thereto.

What is claimed is:

1. A cabinet for displaying objects, said cabinet comprising:

an underpart;

a plurality of side walls extending upwardly from said underpart, said upwardly extending side walls having upper ends;

an upper part for receiving the upper ends of said side walls;

a door having a lower portion and an upper portion, said door being positioned to extend upwardly from the underpart to the upper part;

upper and lower hinge assemblies, said upper hinge assembly including an upper hinge pin, a first portion connected to said upper part, and a second portion connected to the upper portion of said door, said lower hinge assembly including a lower hinge pin, a first portion connected to said underpart, and a second portion connected to the lower portion of said door, each of said first and second hinge portions defining holes therein for extending said respective upper and lower hinge pins therethrough and rotatably connecting said first and second hinge portions together so that said door can be rotated on said hinge assemblies, said door thereby having an inner surface defined as that surface facing toward said cabinet when said door is closed;

upper and lower rods connected to said first hinge portion of said upper and lower hinge assemblies, respectively;

upper and lower bearing bodies mounted in said upper part and said underpart, respectively, for receiving said upper and lower rods, respectively, said rods being therein axially slidable perpendicular to said inner surface when said door is closed; and means having a first end rotatably mounted to said underpart and having a second end rotatably mounted to the lower portion of said door for exerting a predetermined horizontal force against the weight of said door so that when said upper and lower rods are axially extended out from said respective upper and lower bearing bodies and said door is open, the weight of said door does not cause said lower rod to retract into said lower bearing body.

2. The cabinet of claim 1, wherein said side walls comprise transparent material.

3. The cabinet of claim 1, wherein underpart is a pedestal.

4. The cabinet of claim 1, wherein two side walls include outer surfaces and edges, which edges have end surfaces which abut the inner surface of said door when said door is closed, and wherein opposing outer edges of said door terminate flush with the outer surface of each of the two side walls respectively.

5. The cabinet of claim 1, wherein said upper part and said underpart further comprise respectively upper and lower sheet metal frames for securing respectively said upper and lower bearing bodies, said lower frame also securing said means for exerting force.

6. The cabinet of claim 5 wherein said means is a horizontally disposed spring mechanism which is rotatably mounted on an attachment bracket which is fixed to said lower sheet metal frame.

7. The cabinet of claim 5, further comprising a a bracket connected to said underpart wherein the bracket defines a bore, and a lock disposed on said door, said lock comprising first and second opposing sides having respectively first and second push rods operatively connected thereto, wherein said two push rods each project through the bore defined in said bracket when said door is closed and said lock is locked.

8. The cabinet of claim 7, wherein a stud is fixed onto said push rod, and said cabinet further comprises a lower and upper bearing block fitted on said lower and upper sheet metal frames on which bearing block a lever is rotatably mounted by a pin, wherein said lever defines a curve on one side of said pin which bears against a rubber plate fitted on respective upper and lower sheet metal frames, wherein said lever defines on the other side of said pin a receiving opening for engaging said stud fixed to said push rod, and wherein said lever bears against said rubber plate when said push rod moves out of said bore of said bracket.

9. The cabinet of claim 8, further defining a space in said underpart between said door and said lower sheet metal frame and in said upper part between said door and said upper sheet metal frame, for housing said hinge assemblies, said bracket, and said means for exerting a force.

10. The cabinet of claim 7, wherein said lock, said second hinge portions, and said second end of said means for exerting a force are fixed on upper and lower sheet metal plates which are fixed on the inner surface of said upper and lower portions respectively of said door.

11. The cabinet of claim 5, wherein said means is a horizontally disposed gas pressure spring which is rotatably mounted on an attachment bracket which is fixed to said lower sheet metal frame, and further wherein said lower rod defines a longitudinal axis and said attachment bracket is substantially aligned with the axis of said lower rod between said lower hinge assembly and the lower sheet metal frame and said second end of said gas pressure spring is rotatably connected to a bearing which is fitted to said door.

12. The cabinet of claim 5, wherein said lower rod defines a longitudinal axis and said cabinet further comprises a support bracket fixed to the door, a connecting lever rotatably mounted on said support bracket, said lever defining a slot, and further comprising a stud which engages said slot, and an attachment bracket attached to said lower sheet metal frame, said stud being further vertically disposed on said attachment bracket, wherein said support bracket is located between the second hinge portion and the outer edge of said door, said stud being fixed above or below said hinge portions in line with the axis of said lower rod.

13. The cabinet of claim 1, wherein two of said side walls have front ends which bear on said door and said cabinet further comprises a strip fitted on the front ends of said two side walls and on said door at those places on which the front ends of said two sides bear on said door, and wherein said two strips lie in register when said door is closed.

14. The cabinet of claim 1, wherein opaque foil is applied to portions of said door and said side walls to cover said underpart and said upper part.

15. A cabinet for displaying objects, said cabinet comprising:

an underpart having a lower sheet metal frame;

a plurality of side walls extending upwardly from said underpart, said upwardly extending side walls having upper ends;

an upper part having an upper sheet metal frame for receiving the upper ends of said side walls;

a door having a lower portion and an upper portion, said door being positioned to extend upwardly from the underpart to the upper part;

upper and lower hinge assemblies, said upper hinge assembly including an upper hinge pin, a first portion connected to said upper part, and a second portion connected to the upper portion of said door, said lower hinge assembly including a lower hinge pin, a first portion connected to said underpart, and a second portion connected to the lower portion of said door, each of said first and second hinge portions defining holes therein for extending said respective upper and lower hinge pins therethrough and rotatably connecting said first and second hinge portions together so that said door can be rotated on said hinge assemblies, said door thereby having an inner surface defined as that surface facing toward said cabinet when said door is closed;

upper and lower rods connected to said first hinge portion of said upper and lower hinge assemblies, respectively;

upper and lower bearing bodies mounted in said upper and lower sheet metal frames, respectively, for receiving said upper and lower rods, respectively, said rods being therein axially slidable perpendicular to said inner surface when said door is closed; and a substantially horizontally disposed spring having a first end rotatably mounted to said lower sheet metal frame and having a second end rotatably mounted to the lower portion of said door for exerting a predetermined horizontal force against the weight of said door so that when said upper and lower rods are axially extended out from said respective upper and lower bearing bodies and said door is open, the weight of said door does not cause said lower rod to retract into said lower bearing body.

16. The cabinet of claim 15 wherein said spring is a gas pressure spring.

17. The cabinet of claim 16 wherein said first end of said spring is rotatably mounted on an attachment bracket fixed to said lower sheet metal frame.

18. The cabinet of claim 17 wherein said lower rod defines a longitudinal axis and said attachment bracket is substantially aligned with the axis of said lower rod between said lower hinge assembly and the lower sheet metal frame.

19. The cabinet of claim 15 wherein said second end of said spring is rotatably connected to a bearing which is fitted to said lower portion of said door.

20. A cabinet for displaying objects, said cabinet comprising:

an underpart having a lower sheet metal frame;

a plurality of side walls extending upwardly from said underpart, said upwardly extending side walls having upper ends;

an upper part having an upper sheet metal frame for receiving the upper ends of said side walls;

a door having a lower portion and an upper portion, said door being positioned to extend upwardly from the underpart to the upper part;

upper and lower hinge assemblies, said upper hinge assembly including an upper hinge pin, a first portion connected to said upper part, and a second portion connected to the upper portion of said door, said lower hinge assembly including a lower hinge pin, a first portion connected to said underpart, and a second portion connected to the lower portion of said door, each of said first and second hinge portions defining holes therein for extending said respective upper and lower hinge pins therethrough and rotatably connecting said first and second hinge portions together so that said door can be rotated on said hinge assemblies, said door thereby having an inner surface defined as that surface facing toward said cabinet when said door is closed;

upper and lower rods connected to said first hinge portion of said upper and lower hinge assemblies, respectively, and wherein said lower rod defines a longitudinal axis;

upper and lower bearing bodies mounted in said upper and lower sheet metal flames, respectively, for receiving said upper and lower rods, respectively, said rods being therein axially slidable perpendicular to said inner surface when said door is closed;

an attachment bracket fixed to said lower sheet metal frame, said attachment bracket being substantially aligned with the axis of said lower rod between said lower hinge assembly and the lower sheet metal frame; and a horizontally disposed gas pressure spring having a first end rotatably mounted to said attachment bracket and having a second end rotatably mounted to a bearing which is fitted to said door for exerting a predetermined horizontal force against the weight of said door so that when said upper and lower rods are axially extended out from said respective upper and lower bearing bodies and said door is open, the weight of said door does not cause said lower rod to retract into said lower bearing body.

* * * * *